US006253508B1

(12) United States Patent
Ginet et al.

(10) Patent No.: US 6,253,508 B1
(45) Date of Patent: Jul. 3, 2001

(54) BUILDING FRONT COMPRISING ELEMENTS WITH REDUCED WEIGHT

(75) Inventors: Marc Ginet, Saint-Maur; Michel Le Feron De Longcamp, Mathieu, both of (FR)

(73) Assignee: Elf Atochem S.A., Puteaux (FR)

( * ) Notice: Subject to any disclaimer, the term of this patent is extended or adjusted under 35 U.S.C. 154(b) by 0 days.

(21) Appl. No.: 09/269,748

(22) PCT Filed: Oct. 6, 1997

(86) PCT No.: PCT/FR97/01772

§ 371 Date: Jun. 18, 1999

§ 102(e) Date: Jun. 18, 1999

(87) PCT Pub. No.: WO98/15700

PCT Pub. Date: Apr. 16, 1998

(30) Foreign Application Priority Data

Oct. 8, 1996 (FR) ..... 96 12261

(51) Int. Cl.[7] ..... E04B 2/88

(52) U.S. Cl. ..... 52/235; 52/745.1

(58) Field of Search ..... 52/235, 309.6, 52/483.1, 745.1

(56) References Cited

U.S. PATENT DOCUMENTS

| | | | | |
|---|---|---|---|---|
| 2,075,338 | | 3/1937 | Davison . | |
| 3,038,568 | * | 6/1962 | Morgan | 52/235 |
| 3,071,215 | * | 1/1963 | Gall | 52/235 X |
| 3,530,633 | * | 9/1970 | Scott | 52/235 X |

FOREIGN PATENT DOCUMENTS 2 723 387 2/1996 (FR) .

* cited by examiner

*Primary Examiner*—Beth A. Stephan
*Assistant Examiner*—Kevin D. Wilkens
(74) *Attorney, Agent, or Firm*—Jacobson Holman PLLC

(57) ABSTRACT

A building frontage including first frontage elements fixed to the building each including a cellular core and second frontage elements. The first and second frontage elements are arranged in substantially the same plane. The second frontage elements are fixed only to the first frontage elements.

17 Claims, 4 Drawing Sheets

BUILDING FRONT COMPRISING ELEMENTS WITH REDUCED WEIGHT

Figure 1:
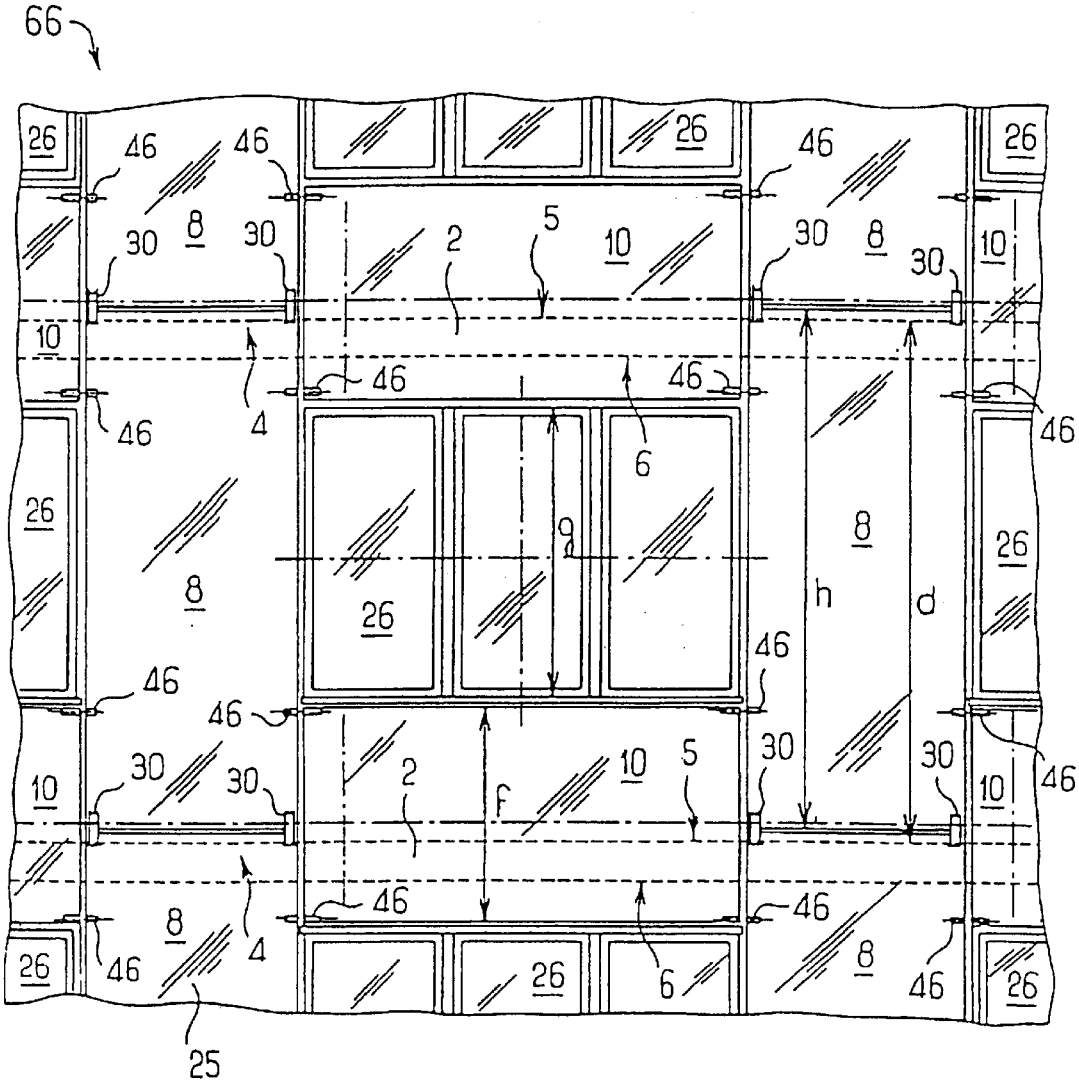

The invention concerns the frontages of buildings, systems for constructing them and methods of constructing them.

"Lightweight" building frontages including lightweight frontage elements comprising a synthetic material cellular web are known per se. The frontage includes fixing members such as long horizontal rails joined to the building. Each frontage element is fixed to a plurality of rails supporting a plurality of frontage elements.

The drawback of this type of frontage is that the fixing members are difficult to transport, manipulate and install because they are large and heavy.

One aim of the invention is to provide a frontage that is easier to construct.

To achieve the above aim, in accordance with the invention a building frontage includes first frontage elements fixed to the building and each comprising a cellular core and second frontage elements, the first and second frontage elements are arranged in substantially the same plane and the second frontage elements are fixed only to the first frontage elements.

Accordingly, the fixing members are connected only to the first frontage elements. The shape and/or dimensions of the fixing members can therefore be modified to make them easier to manipulate. For example, their dimensions can be reduced until they are similar to or less than the dimensions of the first frontage elements.

Each second frontage element is advantageously fixed to four first frontage elements.

Accordingly, particularly reliable fixing of the second frontage elements to the first frontage elements is obtained.

The first frontage elements are advantageously disposed in parallel rows and the second frontage elements are disposed in rows parallel to the rows of first frontage elements.

The first frontage elements are advantageously fixed to floors of the building.

Each first frontage element is advantageously fixed to at least two floors at different levels.

Accordingly, particularly reliable fixing of the first frontage elements to the building is obtained.

Each first frontage element advantageously has a dimension in a direction perpendicular to the floors equal to n times a distance between like faces of two floors adjacent each other in that direction, n being an integer greater than or equal to 1.

Accordingly, first frontage elements and fixing members for fixing them to the building can be made which are identical to each other, which reduces their unit cost.

The frontage advantageously includes first members for fixing the first frontage elements to the building, the first fixing members having dimensions less than a greatest dimension of the first frontage elements.

Accordingly, handling of the first fixing members is facilitated.

Each first frontage element advantageously includes at least one rigid part fixed to the cellular core and the first fixing members are advantageously fixed to the rigid parts.

Accordingly, the mechanical strength of the first frontage elements is increased in the area where they are fixed to the building.

The frontage advantageously includes second members for fixing the second frontage elements to the first frontage elements and the second fixing members are advantageously fixed to the rigid parts.

Accordingly, the mechanical strength of the first frontage elements is increased in the area where the second frontage elements are fixed.

Each first fixing member advantageously includes means for adjusting an angular position of the first fixing member relative to a face of the building in at least one direction.

Accordingly, the fixing member can easily be fixed in a position near the required position.

The adjuster means are advantageously adapted to enable adjustment of the angular position of the first fixing member relative to the face of the building in two mutually perpendicular directions.

Accordingly, the first fixing member can be fixed more accurately.

The adjuster means advantageously include at least one screw-threaded housing in the first fixing member and at least one screw engaged therein, the first fixing member advantageously has two contact portions disposed to form a triangle with the screw and the contact portions and the screw are advantageously adapted to come into contact with the face of the building.

The contact portions advantageously comprise two screws engaged in second and third screw-threaded housings of the first fixing member.

The first fixing member advantageously further includes attachment parts for rigidly fixing the first fixing member to the building.

Accordingly, the function of adjusting the position and the function of fixing to the building are associated with separate parts, so that the parts can be better adapted to their respective functions.

The frontage advantageously further includes components fixed to at least some of the first and second frontage elements and lying in the plane of the first and second frontage elements.

Accordingly, there is no need to fix the components directly to the building, which can be laborious.

The invention also provides a system for constructing a building frontage including first elements comprising a cellular core and adapted to be fixed to a building and second elements, characterized in that it includes means for fixing the second elements to the first elements with the first and second elements in the same plane.

This system is used to construct the frontage in accordance with the invention.

The invention further provides a method of constructing a building frontage using first elements including a cellular core and second elements, in which method the first elements are fixed to the building and the first and second elements are disposed in the same plane and the second elements are fixed to the first elements.

This method is used to construct the frontage in accordance with the invention.

Figure 2:
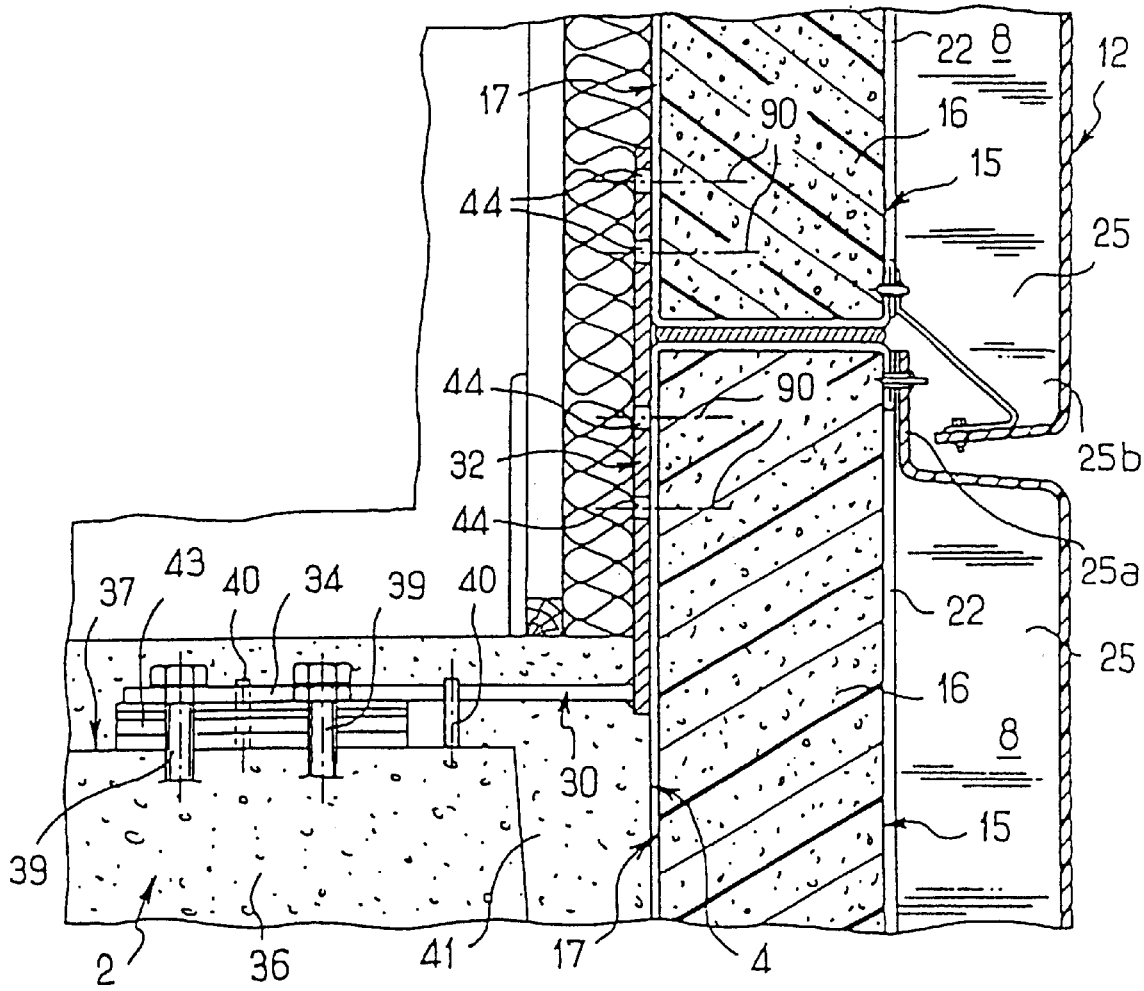
Figure 3:
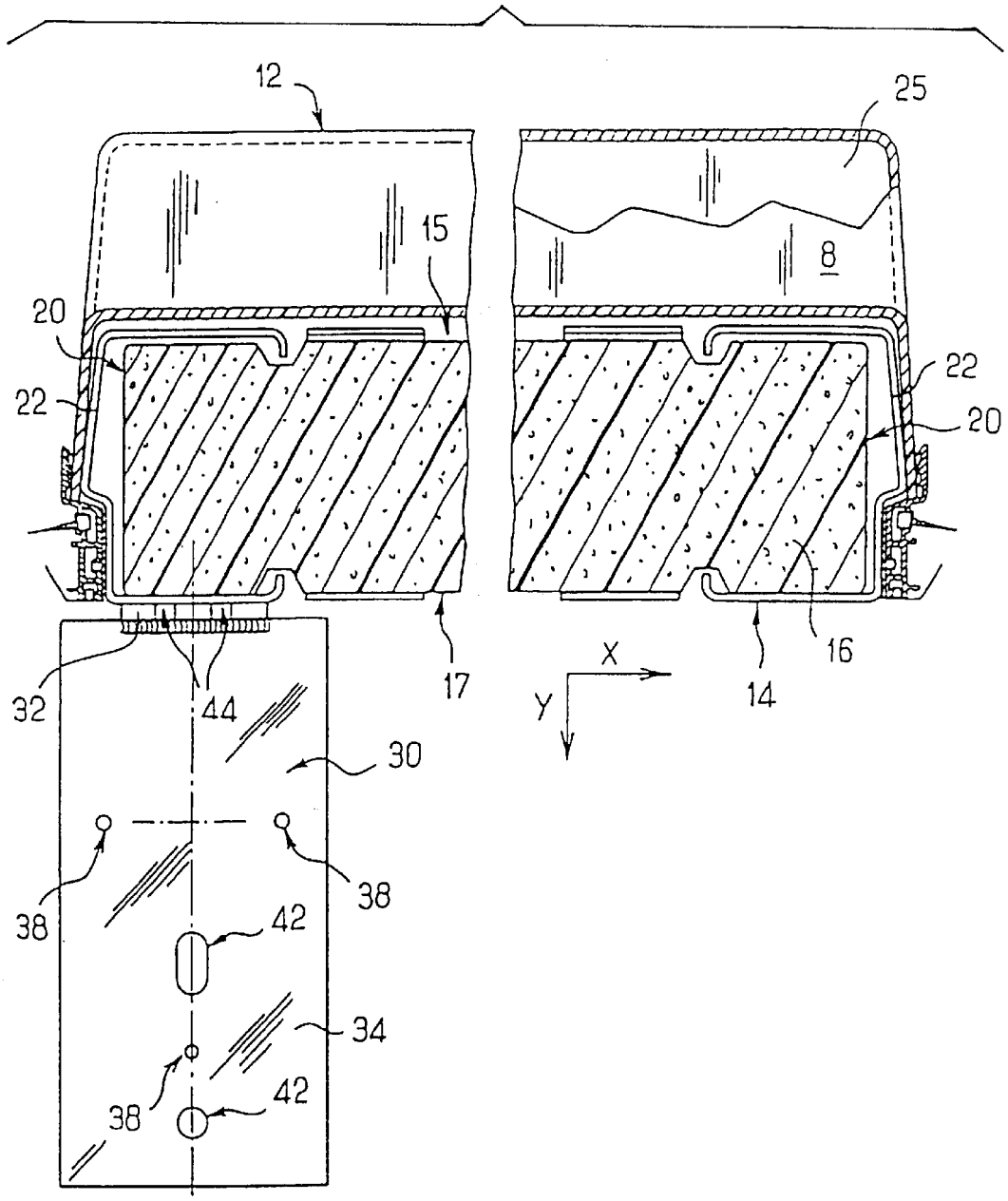
Figure 4:
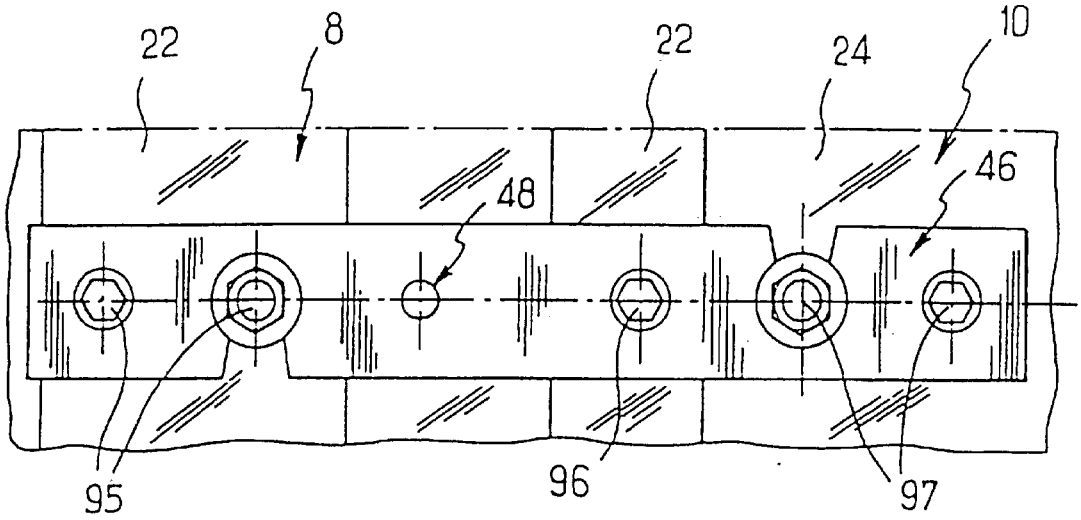
Figure 5:
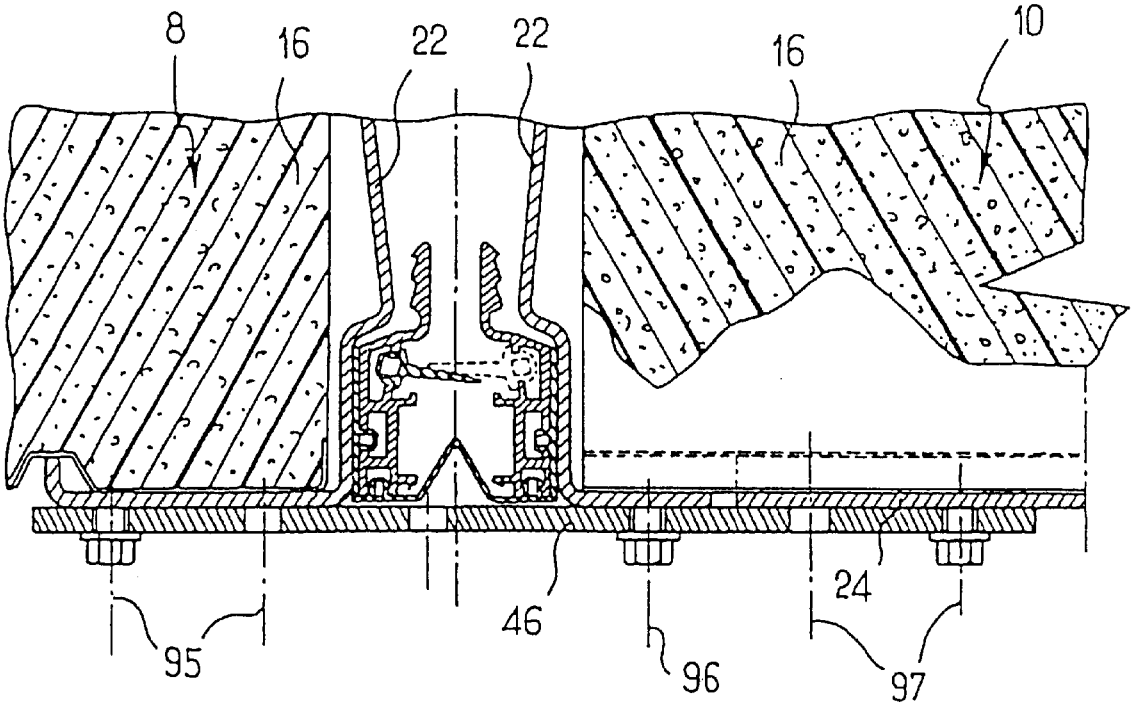

Other features and advantages of the invention will emerge more clearly from the following description of a preferred embodiment of the invention given by way of non-limiting example. In the accompanying drawings:

FIG. 1 is a partial front view of the frontage in accordance with the invention, as seen from outside the building, FIG. 2 is a view of the frontage in cross-section at the level of a first fixing member, FIG. 3 is a top view of the first fixing member from FIG. 2 and a first frontage element in horizontal section, FIG. 4 is a front view of a second fixing member connected to first and second frontage elements, and FIG. 5 is a top view of the second fixing member from FIG. 4 and first and second frontage elements in horizontal section.

This embodiment of the frontage in accordance with the invention is fixed to a building comprising a plurality of horizontal floors 2 constructed principally of concrete and extending at different levels, one above the other. Each floor 2 has a vertical rectilinear edge 4 and these edges are parallel to each other in a common vertical plane. The frontage lies against the edges 4. Each floor 2 has plane horizontal top and bottom faces 5 and 6.

The frontage comprises first frontage elements (window piers) 8 and second frontage elements (filler elements) 10. Each element is generally rectangular parallelepiped-shaped with a large front face 12 and a large rear face 14 that are generally plane and parallel to each other.

Each of the first and second frontage elements 8, 10 has a cellular, for example polyurethane foam, core 16. The core 16 has a front face 15 and a rear face 17 that are parallel to each other and covered with respective metal films 0.05 mm thick. The core 16 has two vertical parallel plane rectilinear lateral faces 20. Each lateral face 20 is associated with a rigid galvanized metal reinforcement section 22 which is 2.5 mm thick and covers the lateral face and part of the front and rear faces 15 and 17 of the core. The reinforcement 22 is fixed to the rear face 17 of the core 16 facing towards the floors 2 with the metal film between them, in surface-to-surface contact with the film. It extends the full height of the core.

The filler elements 10 further include two horizontal rigid reinforcement sections 24 associated in the same manner with top and bottom horizontal plane rectilinear faces of the core 16.

The first and second frontage elements 8, 10 each include a plastics materials, for example PVC, facing panel 25 which faces and is parallel to the front face 15 of the core 16 and conceals it from view from outside the building. The facing panel 25 is on the outside of the frontage element so that it can be seen from outside the building. It has a plane face 12 constituting the front face of the frontage element.

The frontage further includes components such as windows 26 or doors which are generally plane and rectangular when seen in elevation.

The first and second frontage elements 8, 10 and the components 26 are disposed side by side in a common plane adjacent the edges 4 of the floors 2.

The first frontage elements 8 are fixed only to the floors 2 by first fixing members or brackets 30. The first frontage element 8 are disposed in a plurality of spaced parallel vertical rows. The first frontage elements 8 in each row are adjacent each other and have their vertical lateral faces aligned. Each first frontage element 8 has a longitudinal dimension or height h in the vertical direction perpendicular to the floors 2. The dimension h is equal to the distance d between the like faces (for example the top faces 5) of two floors 2 that are adjacent each other in the vertical direction. The distance d is the height of a story of the building.

Each first frontage element 8 is fixed to two adjacent floors 2 at different levels. It is fixed to each floor by two brackets 30 that also fix the next frontage element 8 in the row to the same floor 2.

Each bracket 30 has first and second plates 32, 34 fixed to each other at a right angle. The first plate 32 has four orifices 44 through it for fixing each of two first frontage elements 8 to the bracket by means of two screws or rivets passing through two of the orifices 44. The first plate 32 is vertical and parallel to the rear face 17 of the core and is fixed to each of the two first frontage elements 8 by means of two screws or rivets with axes 90, for example. One of the rods passes completely through the thickness of the core 16 and is connected to one of the vertical rigid reinforcements 22 on either side of the core and the other rod passes through the reinforcement 22 and the core 16. The second plate 34 is horizontal and is embedded in the floor 2. The second plate 34 has three screw-threaded circular housings 38 passing through the thickness of the plate and disposed in a triangle. The bracket includes three grubscrews 40 engaged in the respective housings 38 to project from a face of the second plate 34 opposite the first plate 32.

The bracket 30 is installed in the following manner. A horizontal concrete slab 36 is constructed to form the fabric of the floor 2. A rebate in the slab adjacent the edge 4 of the floor has a generally horizontal plane face 37. The bracket is placed with the first plate 32 directed vertically upwards near the edge 4 of the floor and with the ends of the three grubscrews 40 in contact with the plane face 37 of the rebate. The grubscrews 40 are then turned to adjust the angular position of the bracket 30 relative to the face 37 of the rebate in two mutually perpendicular horizontal directions, for example directions X and Y in FIG. 3. The second plate 34 has two orifices 42, an elongate orifice near the first plate 32 and a circular orifice far away from the first plate. Two attachment screws 39 are engaged in the respective orifices 42. When the bracket is in the required angular position, the fixing screws 39 are screwed into the slab 36 to fix the bracket rigidly to the slab. A filler material such as mortar 41 is then poured into the rebate to fill the rebate completely and cover the horizontal second plate 34 without covering the vertical first plate 32. When it has hardened this material immobilizes the bracket. After tightening the fastening screws 39, one or more shims 43 can be placed between the horizontal second plate 34 and the top face 37 of the rebate. The dimensions of the brackets 30 are very much less than the dimensions of the first and second frontage elements 8, 10 in the horizontal and vertical directions, and in particular less than the greatest dimension of these elements.

The two frontage elements 10 and the components 26 have the same horizontal dimension or length and are disposed in a plurality of spaced vertical rows alternating with the rows of first frontage elements 8. The second frontage elements 10 and the components 26 alternate in each row and their vertical lateral faces are aligned with each other. The second frontage elements 10 have a vertical dimension or height f and the components 26 have a vertical dimension or height g. The sum of the height f and the height g is equal to the height h of the first frontage elements 8.

Each second frontage element 10 is opposite two first frontage elements 8 of each adjacent row. Each second frontage element 10 is fixed only to these four first frontage elements 8. Each component 26 is fixed only to a first frontage element 8 of each adjacent row.

The second frontage elements 10 are fixed by second fixing members such as horizontal elongate plane metal lugs 46 fixed to the vertical reinforcements 22 of the first frontage elements 8. The lug 46 has six orifices 48 through it. Two of the orifices 48 receive fastenings such as screws or rivets with axes 95 passing through a vertical reinforcement 22 and the core 16 of the associated first frontage element 8. A third orifice 48 receives a fastener with axis 96 passing through a vertical reinforcement 22 and the core 16 of the second frontage element 10. Two other orifices 48 receive two fasteners with axes 97 passing through one of the horizontal reinforcements 24 of the second frontage element 10.

The panels 25 of the first frontage elements 8 have a profile in vertical cross-section such that the panel has a top area 25*a* near the core 16 and a bottom area 25*b* far away from the core and covering the outside of the top area 25*a* of the adjacent first frontage element 8 in the row. This produces an overlapping tile-like arrangement which conceals the junctions between the horizontal faces of the first frontage elements 8.

The frontage is therefore constructed by means of a system comprising first elements 8 having a cellular core 16 and adapted to be fixed to a building, second elements 10 and means 30 for fixing the second elements 10 to the first elements 8 with the first and second elements 8, 10 in the same plane.

Construction involves fixing the first elements 8 to the building, disposing the first elements 8 and the second elements 10 in a common vertical plane, and fixing the second elements 10 to the first elements 8.

The frontage obtained in this way is light in weight.

Of course, many modifications can be made to the invention without departing from its scope.

The wall 66 of the panels 25 can have varied shapes, raised patterns and colors to suit the requirements of the frontage designer. The panel 25 is advantageously a thermoformed component.

What is claimed is:

1. A building frontage including first frontage elements fixed to the building and each comprising a cellular core made of synthetic material, and second frontage elements, the first and second frontage elements being arranged in substantially a same plane, the second frontage elements being fixed only to the first frontage elements.

2. A building frontage according to claim 1, wherein each second frontage element is fixed to four first frontage elements.

3. A building frontage according to claim 1, wherein the first frontage elements are disposed in parallel rows and the second frontage elements are disposed in rows parallel to the rows of first frontage elements.

4. A building frontage according to claim 1, wherein the first frontage elements are fixed to floors of the building.

5. A building frontage according to claim 4, wherein each first frontage element is fixed to at least two floors at different levels.

6. A building frontage according to claim 4, wherein each first frontage element has a dimension in a direction perpendicular to the floors equal to n times a distance between like faces of two floors adjacent each other in said direction, n being an integer greater than or equal to one.

7. A building frontage according to claim 1, wherein the frontage includes first fixing members for fixing the first frontage elements to the building, the first fixing members having dimensions less than a greatest dimension of the first frontage elements.

8. A building frontage according to claim 7, wherein each first fixing member includes adjuster means for adjusting an angular position of the first fixing member relative to a face of the building in at least one direction.

9. A building frontage according to claim 8, wherein the adjuster means are adapted to enable adjustment of the angular position of the first fixing members relative to the face of the building in two mutually perpendicular directions.

10. A building frontage according to claim 9, wherein the adjuster means include at least one screw housing in the first fixing members and at least one screw engaged therein.

11. A building frontage according to claim 10, wherein two screws are engaged in second and third screw housings of the first fixing members.

12. A building frontage according to claim 8, wherein the first fixing members further include attachment parts for rigidly fixing the first fixing members to the building.

13. A building frontage according to claim 7, wherein each first frontage element includes at least one rigid part fixed to the cellular core and the first fixing members are fixed to the rigid parts.

14. A building frontage according to claim 13, wherein the frontage includes second fixing members for fixing the second frontage elements to the first frontage elements and the second fixing members are fixed to the rigid parts.

15. A building frontage according to claim 1, further comprising components fixed to at least some of the first and second frontage elements and lying in the plane of the first and second frontage elements.

16. A system for constructing a building frontage including first elements comprising a cellular core made of synthetic material and adapted to be fixed to a building and second elements, means for fixing the second elements to the first elements with the first and second elements in a same plane, the second elements being fixed only to the first elements.

17. A method of constructing a building frontage using first elements including a cellular core made of synthetic material, and second elements, the method comprising fixing the first elements on the building, disposing the first and second elements in a same plane, and fixing the second elements only to the first elements.

* * * * *